US009168449B2

(12) United States Patent
Lenhart et al.

(10) Patent No.: US 9,168,449 B2
(45) Date of Patent: Oct. 27, 2015

(54) POLE BASKETS FOR SKI POLES FOR THE TOURING SECTOR, WHICH POLE BASKETS CAN BE FOLDED IN THE DIRECTION OF THE POLE TIP

(75) Inventors: Klaus Lenhart, Ohmden (DE); Anna Friederike Lenhart, legal representative, Kirchheim (DE); Markus Sebastian Lenhart, legal representative, Kirchheim (DE); Eberhard Heim, Unterensingen (DE)

(73) Assignee: LEKISPORT AG, Baar (CH)

( * ) Notice: Subject to any disclaimer, the term of this patent is extended or adjusted under 35 U.S.C. 154(b) by 0 days.

(21) Appl. No.: 13/983,703

(22) PCT Filed: Jan. 27, 2012

(86) PCT No.: PCT/EP2012/051335

§ 371 (c)(1),
(2), (4) Date: Aug. 28, 2013

(87) PCT Pub. No.: WO2012/104212

PCT Pub. Date: Aug. 9, 2012

(65) Prior Publication Data

US 2013/0328297 A1 Dec. 12, 2013

(30) Foreign Application Priority Data

Feb. 4, 2011 (CH) ..... 217/11

(51) Int. Cl.
*A63C 11/24* (2006.01)

(52) U.S. Cl.
CPC ..... *A63C 11/24* (2013.01)

(58) Field of Classification Search
CPC ..... A63C 11/24
USPC ..... 280/819, 824
See application file for complete search history.

(56) References Cited

U.S. PATENT DOCUMENTS 3,645,553 A 2/1972 Hinterholzer
3,963,254 A 6/1976 Aho (Continued)

FOREIGN PATENT DOCUMENTS

DE 14 78 108 A1 8/1969
DE 1 946 670 A1 4/1970
DE 29 52 149 A1 7/1981
WO 2008/000109 A2 1/2008

OTHER PUBLICATIONS

English translation of International Preliminary Report on Patentability dated Jan. 27, 2012.

(Continued)

*Primary Examiner* — Frank Vanaman
(74) *Attorney, Agent, or Firm* — Sughrue Mion, PLLC

(57) ABSTRACT

A pole basket (8) for a ski pole, cross-country pole, trekking pole, Nordic walking pole, or hiking pole, in particular for a ski pole for the touring sector, wherein the pole basket (8) has a planar basket region (9, 11, 15). The pole basket is characterized in that the basked region (9, 11, 15) can be folded in a folded state at least in some regions in the direction of a pole tip (5,7), and can be opened in the opposite direction to a stop, at which the basket region forms a flat or only unsubstantially curved plane, and that the pole basket (8) is transferred into the folded state by a force acting on a upper face of the basket region (9, 11), and that the pole basket returns to the open state independently when said force is removed.

22 Claims, 4 Drawing Sheets

(56) References Cited

U.S. PATENT DOCUMENTS

| | | | | |
|---|---|---|---|---|
| 4,589,681 | A * | 5/1986 | Erickson | 280/819 |
| 4,921,275 | A * | 5/1990 | Santanen et al. | 280/824 |
| 2008/0169012 | A1* | 7/2008 | Gillanders | 135/84 |
| 2010/0001504 | A1* | 1/2010 | Virostek | 280/824 |
| 2011/0272932 | A1* | 11/2011 | McLain | 280/824 |

OTHER PUBLICATIONS

International Search Report for PCT/EP2012/051335 dated May 25, 2012.

* cited by examiner

POLE BASKETS FOR SKI POLES FOR THE TOURING SECTOR, WHICH POLE BASKETS CAN BE FOLDED IN THE DIRECTION OF THE POLE TIP

CROSS REFERENCE TO RELATED APPLICATIONS

This application is a National Stage of International Application No. PCT/EP2012/051335 filed Jan. 27, 2012, claiming priority based on Swiss Patent Application No. 00217/11 filed Feb. 5, 2011, the contents of all of which are incorporated herein by reference in their entirety.

TECHNICAL FIELD

The present invention relates to a pole basket for a ski pole, cross-country pole, trekking pole, Nordic walking pole or hiking pole, particularly for a ski pole intended for the touring sector.

PRIOR ART

Especially with ski tours, it is important to have ski poles that are as rugged and reliable as possible for the climb as well as the descent. These poles may have a telescoping design and usually feature a handle on top and a pole basket on the bottom.

The basket surface of the pole basket is as large as possible to ensure that the wide support area with its large effective cross section provides a good amount of support when the pole is planted, especially while skiing in soft snow, for example. It would be ideal to have a range of basket sizes available to accommodate diverse conditions, but this is usually difficult to realize on a practical level, since ski tours in particular require equipment with minimal weight. This makes it undesirable to carry additional materials for various situations.

In other words, it is key to find the right compromise between a large basket and a sufficient amount of manageability. What is especially problematic for large baskets is that during periods when changes in the snow have caused a layer of ice or hard snow to form on the surface, the attempt to extract the pole from the snow during climbs and descents may cause these baskets to get trapped in that snow crust. The problem is exacerbated by the fact that the pole is usually planted in a vertical or even forward-facing position, followed by a forward movement by the climbing or descending skier, after which the pole shaft—which has basically moved forward inside a slot—has to be pulled out again. As a result, the pole is pulled out in an area that has not already been pierced by the basket, which means that it also has to be pulled through the entire snow layer above it, including any hard layer of snow or ice that may be covering it. This is unpleasant when climbing and may lead to difficulties in balancing during descents, which may even be fatal to touring skiers on difficult terrains.

SUMMARY OF THE INVENTION

Accordingly, one of the objects of the present invention is to provide an improved pole basket, especially for use in mostly unpacked snow or snow crusts, which is able to avoid or at least reduce the above-mentioned disadvantages.

Therefore the present invention pertains to a pole basket with the characteristics as specified in claim 1, namely a pole, particularly a ski pole for the touring sector, with this kind of pole basket.

Specifically, it concerns the improvement of a pole basket for a ski pole, cross-country pole, trekking pole, Nordic walking pole or hiking pole, particularly for a ski pole intended for the touring sector, in which the pole basket has a flat basket region surface. In particular, this invention provides the pole basket with an improved design. First, at least some sections of the basket region can be folded towards a pole tip and, conversely, can be opened in the opposite direction up to a stop where the basket region forms a flat or only minimally curved plane. Second, the pole basket is folded by means of a force acting on the top of the basket region (i.e. the side facing away from the tip) so that when this force is removed, it returns to the open position, or at least semi-opened position, independently. In the latter case, when the basket next meets the layer of snow, it will completely open up again through the resulting counter-pressure.

In other words, the pole basket is designed in such a way that once it has deeply penetrated the snow, the act of pulling it out through the snow cover or the overlaying coat of ice (snow crust) results in it being folded in towards the bottom (comparatively little force is therefore required to fold the pole basket), reducing the effective cross section. Accordingly, the pole or pole basket no longer has to be pulled from the snow or layer of ice with its complete effective cross section exposed. Instead, its effective cross section is much smaller, cutting through the overlaying material essentially without resistance and therefore with greater ease for the user. Once the pole basket has moved to the top of the snow layer, the restoring force provided by the pole basket automatically causes it to return to an opened or semi-opened position (or a position between these); it regains its original, ideal effective cross section, and therefore supports itself with its optimal effectiveness the next time it is planted on the snow.

The first preferred embodiment for such a pole basket is characterized by at least two, but preferably exactly two, wings in the basket region that can be folded towards the pole tip (i.e. towards the bottom). Using exactly two of these basket wings and preferably positioning them around a shared hinge or two hinges that are basically parallel or arranged at a sharp angle so that they can be folded towards the pole tip allows for the creation of what is essentially a blade that can be pulled optimally out of the layers of snow.

In general, as preferred according to another embodiment, the basket region can feature a mounting plate that can be rigidly connected to a pole shaft. The basket wings are joined to the bottom or edge of this plate. The mounting plate preferably covers at least part of the upper face of the basket wings in the hinge area; preferably it covers the wings completely with an overlapping area. This ensures that the snow (or ice, or possibly snow that may be freezing due to the accumulation and compression caused by at least one of the hinge movements), which presses down on the pole basket from the top as the pole is pulled out, is unable to enter the hinge area—i.e. the expansion joints, the released joint area of the hinge when the basket wings are folded down—and thereby block the hinge, interfering with or even preventing the folding back of the basket wings by virtue of the above-mentioned restoring force into the opened (full or partial) basket position that is optimal for the pressure on the bottom of the basket. To protect the hinge, it is also (or even additionally) possible—especially when the basket wings are attached to the sides of such a mounting plate—to design a cover on the upper face of the hinge, such as a movable strap or movable tape, which at least covers the hinge. This cover could be an elastic film, for example, which stretches across the upper face of the basket, at least in part. The cover, which can also be provided as a molded part, can be attached to the upper face of the basket by rivets or other fastening elements. It is also possible to use a form-integrated clamp, a snap closure or other composite or a combination of materials to attach this cover. This cover can also be designed in a removable way, making it easy to replace in case the cover is ever damaged. Here the cover should enable the intended folding of the pole basket by ensuring the corresponding freedom of movement, which can also be accomplished by means of an elastic and/or accordion-like and/or similarly designed elastic pleat in the cover area around the expansion joint or hinge area, for example. It is necessary to ensure that the restoring force is kept to a minimum here so that the pole basket that has sunk into the snow will fold as intended when it is pulled out. It is also important to use materials that will maintain their characteristics even at low temperatures (around −30° C.). For example, it is recommended that an elastic film is used that does not become brittle until the temperatures drop below those customary during the intended use of the pole basket.

Here it can also be the case that the expansion joint will open towards the bottom, causing material to get into the expansion joint or hinge area from the bottom due to the pressure of the pole basket on the snow or ice, possibly interfering with the hinge movement as described above. An expert can adapt the technical solutions described above to address this case. It can also be advantageous if the cover hermetically seals at least the area of the expansion joints, at least towards the top (and/or the bottom), i.e. in the direction from which the material can enter.

In addition to protecting the hinge's expansion joints from material entering it, it is furthermore conceivable that this cover at least partially provides the mentioned restoring force needed to fold the basket wing back down.

An elastic cover, for example, one that covers at least the area around the expansion joint or hinge area and is stretched by the opening of the expansion joint when the pole basket is folded, can release the energy gained from the elastic deformation at least partially to return the basket wings once the pressure responsible for the folding is removed.

Furthermore, it is possible to designate means to clear out the expansion joints, for example through correspondingly designed edge geometries, which push the compressed snow towards the outside when the basket wings are reset.

The above-mentioned overlapping area preferably also serves as the upper stop in the opened position.

Another preferred embodiment features two basket wings that are attached to the bottom of the mounting plate facing the pole tip by means of a hinge.

A regular hinge can be used here, i.e. one in which the separate parts are connected through a hinge axis element (hinge pole). In this case, to simultaneously provide the restoring force to reset the basket to an opened or semi-opened position, a leaf spring or another elastic element is the best choice. It is also conceivable to attach the above-mentioned cover, which, as explained earlier, will then provide the restoring force.

Alternatively it is possible to use a film hinge, potentially with the corresponding cover. With the right configuration, such a hinge could also ensure an elastic reset process.

The basket wings can thus be attached to such a mounting plate with a film hinge. This film hinge could consist of or incorporate a fully elastic synthetic material, and/or synthetic ribbon material (braided, woven), and/or a fiber-reinforced synthetic material or fiber-reinforced, rubberized elastic material. It is preferable to select a material that can survive many movement cycles, stays sufficiently flexible throughout its lifecycle and still provides enough restoring force (ideally the film hinge will function as a hinge as well as a reset element, due to its elastic inherent rigidity), and, above all, that can maintain these properties even at low temperatures (typically at temperatures as low as −30° C.) Possible materials include thermoplastic synthetics, for example.

Preferably two hinges are provided for two basket wings through a synthetic layer (or corresponding tape material) attached at the bottom, which stretches across both hinge sections.

The cover could, for example, consist of a silicone film or skin, or a similar, cold-resistant elastic and yet abrasion-resistant elastomeric material placed above the expansion joints and attached to the wing and advantageously to the mounting plate, as previously described.

According to another preferred embodiment, the mounting plate has an elongated shape and substantially extends across the entire diameter of the pole basket, while the long axis of the mounting plate preferably extends along a direction of movement.

The mounting plate can be centrally attached to the pole shaft, or to a fastening section on the pole shaft intended for this purpose, and/or be adapted to this pole, but preferably it is attached to the pole shaft near one of its peripheral end regions.

In order for the pole basket to cut itself out of the snow or ice even more easily, it is possible to provide at least one rib or ridge located on the upper face of the mounting plate facing away from the pole tip and extending towards the top. Preferably this element extends across at least half of the length of the mounting plate, ideally across at least two thirds of the mounting plate and parallel to it.

With respect to the pole axis, the basket region preferably has an asymmetrical design, especially with the attachment of the pole shaft facing forward in the direction of movement. Additionally, the basket region should be preferably shaped with a slightly concave curvature in the direction of the pole tip, where the axis of the concave curvature is parallel to one of the longitudinal axes of a mounting plate (and therefore parallel to the direction of movement), which the foldable elements of the basket region are joined to.

Another preferred embodiment of the pole basket suggested here features a basket region with exactly two basket wings that can be folded in the direction of the pole tip and which are arranged to be foldable towards the pole tip around a joint hinge, two parallel hinges or hinges arranged at a sharp angle, where the basket wings are essentially parallel to each other when folded and positioned to lie against a section of the pole tip.

A further characteristic of the pole basket could be that it is joined to a mounting area of the pole shaft as well as an extension of the tip, and/or constructed in one piece with these elements, where the pole shaft is preferably attachable in a blind hole recess on the upper face (form-fitting and/or frictional connection and/or adhesive bond) in the mounting area.

The basket region still preferably features at least two basket wings that can be folded in the direction of the pole tip and which are arranged to be foldable around a joint hinge, two parallel hinges or hinges arranged at a sharp angle towards the pole tip, where the basket wings are designed with recesses.

Furthermore, the present invention refers to a ski pole, cross-country pole, trekking pole, Nordic walking pole or hiking pole, particularly a ski pole intended for the touring sector, with a pole basket with the characteristics listed above or mentioned at the end.

Additional embodiments are listed in the dependent claims.

BRIEF DESCRIPTION OF THE DRAWINGS

The preferred embodiments for the invention are described below with the aid of drawings, which serve explanatory purposes only and should not be construed as restrictive. In the drawings.

DESCRIPTION OF PREFERRED EMBODIMENTS

Figure 1A:
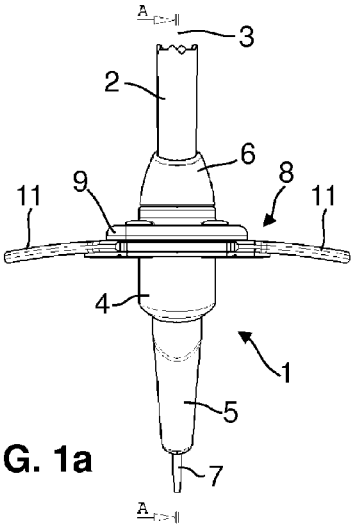
FIG. 1 shows a foldable pole basket in various depictions, in an open, completely unfolded state, where a) shows a view from the front; b) a side view; c) a view in the direction of movement from the back; d) a view from above; e) a view from below; f) an axial central cross section represented by the lines A-A as in a); g) a cross section of the rear pole basket region at a plane from B-B as represented in FIG. 1*b*); h), a perspective view from the front inclined from above; and i) a perspective view inclined from below.
Figure 1B:
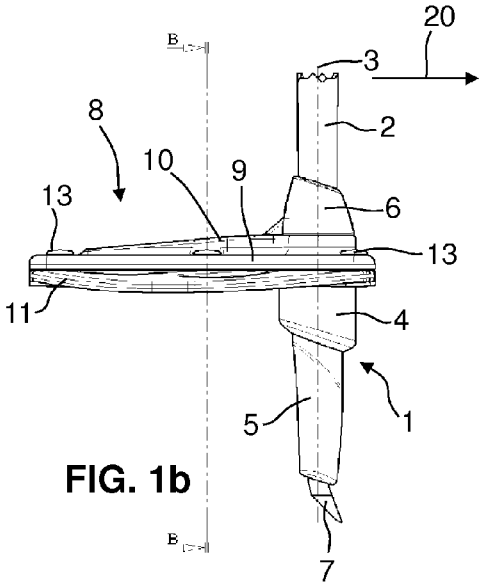
Figure 1C:
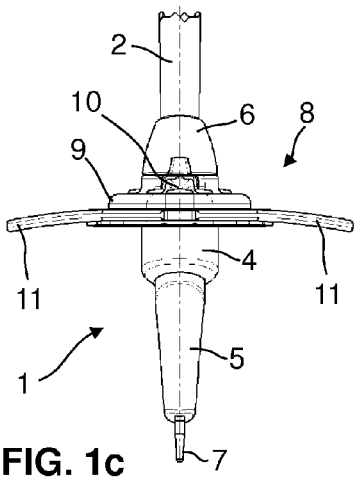
Figure 1D:
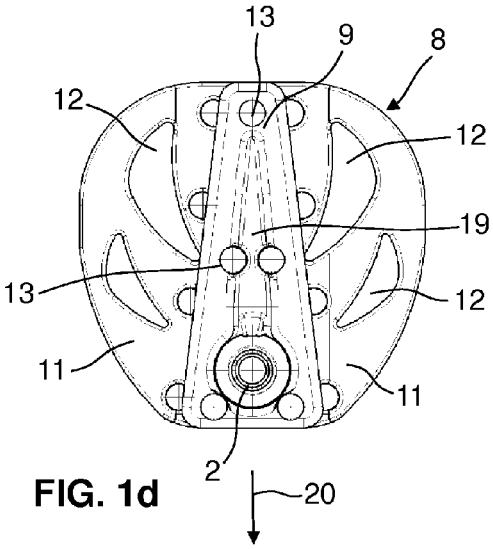
Figure 1E:
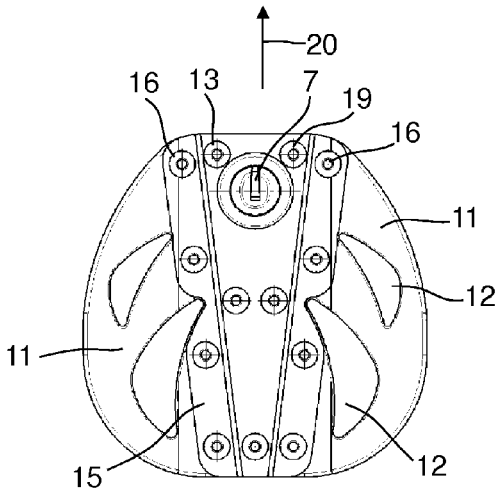
Figure 1F:
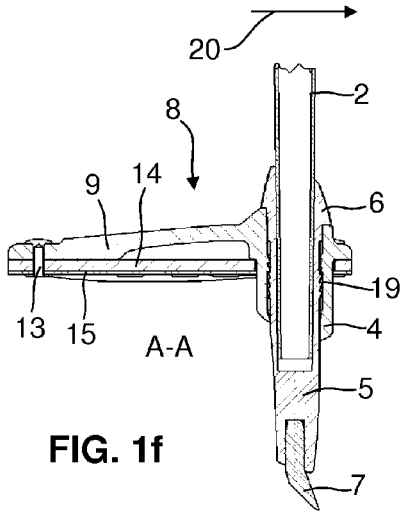
Figure 1H:
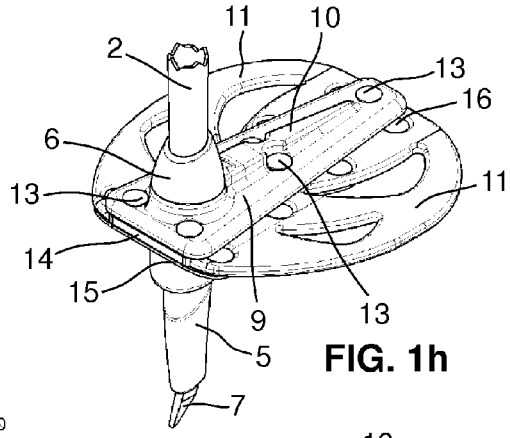
Figure 1G:
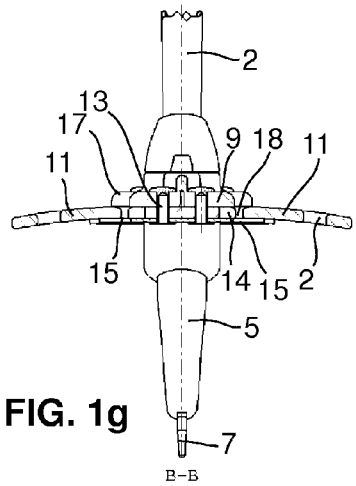
Figure 1I:
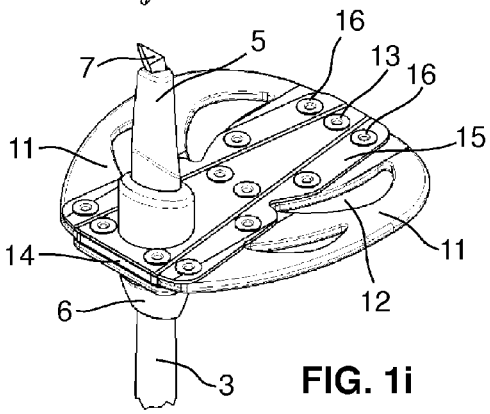
Figure 2A:
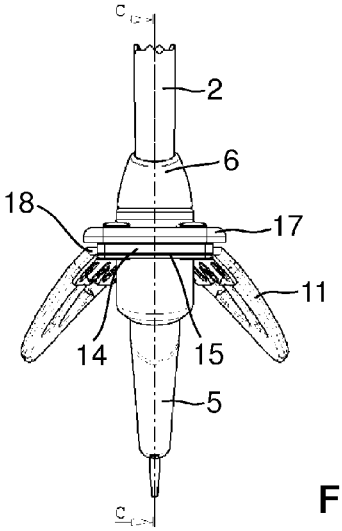
FIG. 2 shows different views of this foldable pole basket in a semi-folded state, where a) shows a view from the front; b) a view from the back; c) a cross section along the plane from D-D in FIG. 2*d*); d) a side view; e) a perspective view inclined from above; and f) a perspective view inclined from below.
Figure 2B:
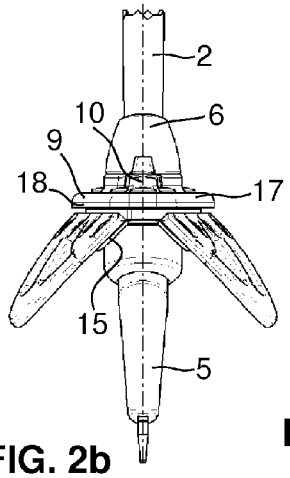
Figure 2C:
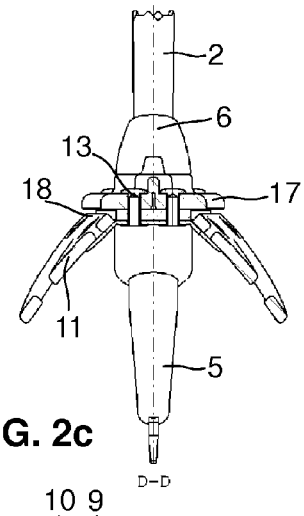
Figure 2D:
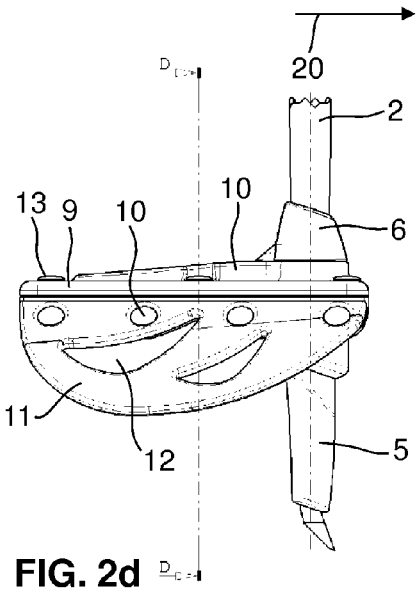
Figure 2E:
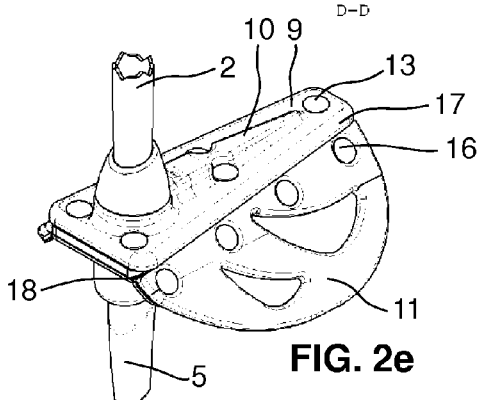
Figure 2F:
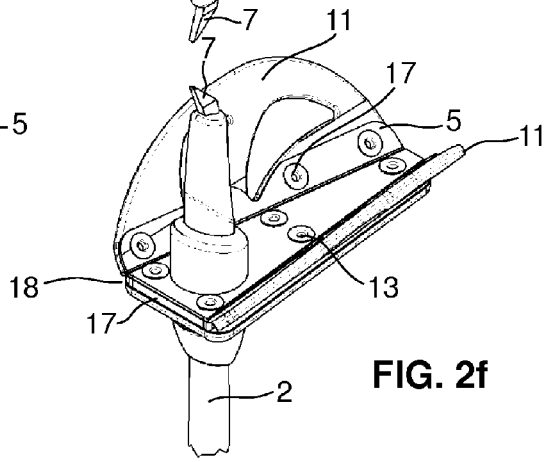
Figure 3A:
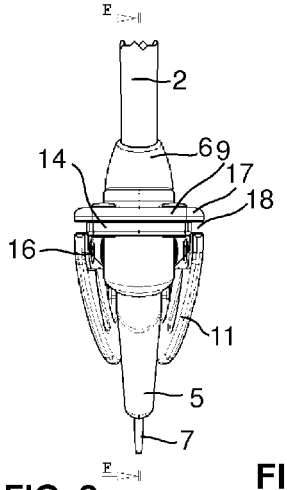
FIG. 3 shows different views of the foldable pole basket in a completely folded state, where a) shows a view from the front; b) a view from the back; c) a cross section along the plane from F-F in FIG. 3*d*); d) a side view; e) a perspective view inclined from above; f) a perspective view inclined from below and g) a view from above.
Figure 3B:
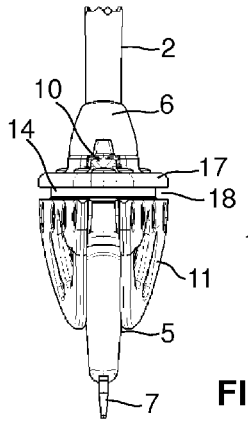
Figure 3C:
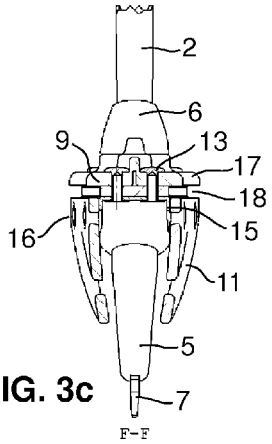
Figure 3D:
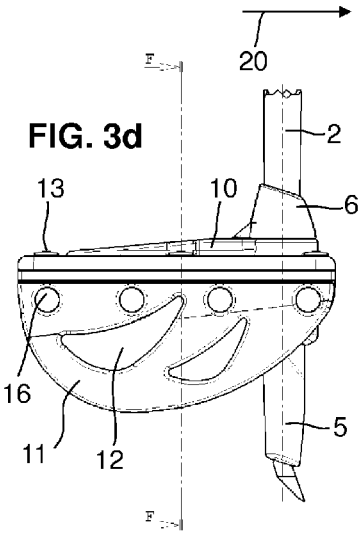
Figure 3E:
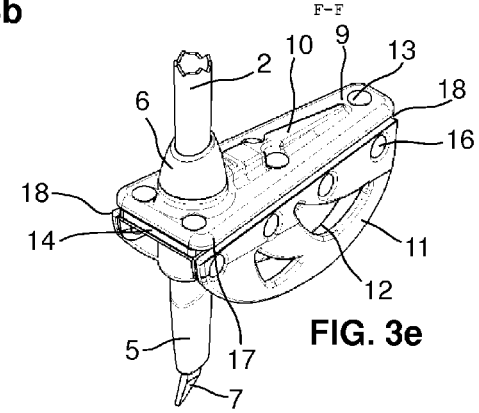
Figure 3F:
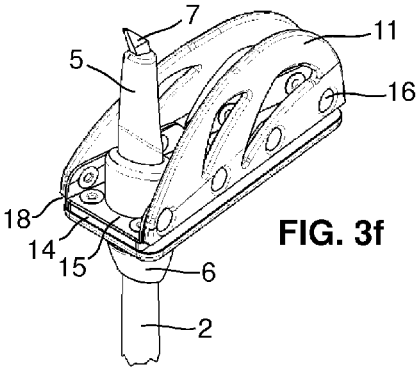
Figure 3G:
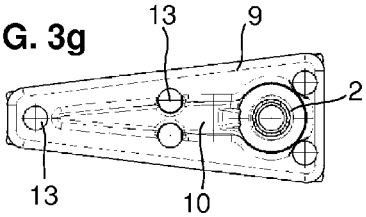

The figures depict one possible embodiment of such a foldable pole basket, where FIG. 1 shows the completely opened state in various depictions, FIG. 2 shows the semi-folded state and FIG. 3 shows a completely folded state, in which the pole basket has the smallest effective cross section. The same reference symbols in the figures indicate the same elements.

The pole basket 8 shown in the open state in FIG. 1 has the largest effective cross section. If the pole basket is not manipulated from the outside, it will be in this opened state, i.e. if it is folded and then released or if any corresponding forces are removed, the pole basket automatically returns to the open or unfolded state shown in FIG. 1.

Specifically, this pole basket 8 can be realized by providing a tip attachment 1 mounted to a pole shaft 2. This tip attachment 1 typically has an upper mounting area 6 and a tip extension 5 on the bottom, with a hardened tip 7 embedded in its bottom end. From the top, the upper mounting area 6 has a blind hole in which the bottom end of the (in this case) butted pole shaft 2 is embedded, typically by being glued or pressed in. The actual pole basket attachment 8 is mounted on this tip construction, which usually consists of plastic (of course the hardened tip 7 is usually made of hardened metal). To enable the attachment of different pole baskets, such a tip attachment typically has an exterior interlocking connection on its upper third (see especially FIG. 1*f*), which is enveloped by a plastic element 4 or a circumferential sleeve of the actual pole basket 8. Accordingly, different pole baskets can be pushed onto such a tip attachment 1 from the bottom up to a stop in the upper mounting area, snapping into place via the interlocking connection 19, which is provided on the exterior of the tip extension area 5 and, correspondingly, in the opposite direction on the inside of the recess in the plastic element 4.

The pole basket 8 now clasps a mounting plate 9 that is positioned against or attached to the plastic element 4 and that—in reference to the direction of movement 20—extends towards the back. In this example, this plate has a trapezoidal design with rounded corners (see FIG. 1*d*). The length of the mounting plate 9 in the direction of movement is greater than the width perpendicular to the direction of movement, and it is wider in front in the direction of movement than in the back, since the pole shaft or plastic element 4 are located as close to the front end as possible.

On the upper face, the mounting plate 9 has a rib 10 extending towards the top, which, as already explained above, can make it easier for the pole basket to efficiently cut through overlying layers as it is being pulled out.

Two basket wings 11 are joined to the bottom of the mounting plate 9. In reference to the direction of movement 20, these basket wings 11 extend to two sides and can be folded in towards the bottom (see FIGS. 2 and 3). They are attached to the bottom of the mounting plate 9, since a rigidly attached retainer area is located directly below the mounting plate, consisting of a material with the same thickness as that of the basket wings 11. This rigidly attached retainer area 14 is attached to the mounting plate 9 from the bottom by means of rivets 13 or screws. The two wing-shaped basket wings 11 are positioned on the side of this retainer area 14 so that their edges are parallel to the edges of the retainer area; they are not attached directly to the mounting plate 9 but fastened indirectly through a bottom layer 15 consisting of hinge material. The hinge material layer 15 extends across the entire bottom part of the retainer area 14 and is fastened to the rigid mounting plate with the above-mentioned rivets 13; however, it continues to extend on the sides and partially protrudes beyond the bottom of the basket wings so that the layer 15 covers the bottom section in which the adjoining edges of the basket wings 11 and retainer area 14 border against each other. The basket wings 11 are also attached to this hinge material layer 15 by means of rivets 16. Of course the rivets 13/16 can be replaced with other fastening methods, such as gluing, sewing and the like; it is also possible to design the elements 14, 15 and 11, for example, as a single injection-molded piece.

This means that a gap 18 remains between the basket wings 11 and retainer area 14, which is open towards the top and bridged by the hinge material 15 on the bottom. However, the section 18 that is open towards the top is covered by a cover section 17 (that protrudes sideways above the hinge area) of the mounting plate 9. This ensures that no snow can enter the gap 18 from the top, blocking the hinge; at the same time, the cover section 17 functions as a stop for the basket wings 11, i.e. the basket wings 11 can be folded down around the film hinge (especially visible in FIG. 1*g*), but they cannot be folded further towards the top, since their periphery will abut against the coverage area 17.

In other words, the two basket wings 11 cannot be moved further upwards from the position depicted in FIG. 1, i.e. in the opposite direction from the pole tip; however, if one presses them from the top, they can be folded down against a restoring force. In that case they move downward like wings. FIG. 2 depicts the two basket wings 11 in a semi-folded state. Here it can be seen how, even in this semi-folded state, a kind of blade is starting to form, due to the wedge-shaped arrangement of the basket wings 11 and the wedge-shaped rib area 10 positioned on the upper face. Therefore, if such a pole basket is pulled from the snow, the pressure of the overlying snow causes the basket wings 11 to move against the elastic restoring force to the bottom, thus successively reducing the effective cross section, so that the pole can easily be pulled up.

The completely folded state is shown in FIG. 3. Here the wings 11 are folded to such a degree that they actually abut the tip extension area 5. This way the pole basket's cross section is reduced to a minimum, which can be seen especially in FIG. 3*g*). If the force of the snow is sufficiently great, such a folded pole basket can also be effortlessly pulled from hard snow, even that with an overlying layer of ice, without getting caught. Furthermore, due to the clever arrangement of the cover section 17, the risk that snow or ice can penetrate into the gap 18 of the open film hinge is mostly eliminated, even in a folded state. This guarantees that the hinge will not be blocked by any ice or snow entering it. An additional flexible protective layer can be provided above the hinge area 18 should one want to reduce this effect even more.

Due to the restoring force of the film hinge, the pole basket automatically returns from the folded state 3—which the pole basket is in only when the basket wings 11 are actively pushed together—to the open position as depicted in FIG. 1 when it is released, or when it is no longer subjected to pressure from the overlying snow. This means that the pole basket automatically returns into the state in which the pole can be planted in the snow again, namely the one with the large effective cross section or application cross section as shown in FIG. 1.

| LIST OF REFERENCE NUMERALS | |
|---|---|
| 1 | Tip attachment |
| 2 | Pole shaft |
| 3 | Pole axis |
| 4 | Plastic element of 8 |
| 5 | Tip extension of 1 |
| 6 | Upper mounting area of 1 |
| 7 | Hardened tip of 1 |
| 8 | Pole basket |
| 9 | Mounting plate of 8 |
| 10 | Rib on the upper face of 9 |
| 11 | Basket wings |
| 12 | Recesses in 11 |
| 13 | Rivets connecting 14 and 15 to 9 |
| 14 | Rigidly attached retainer area |
| 15 | Hinge material |
| 16 | Rivets connecting 11 to 15 |
| 17 | Cover section of 9 over 18 |
| 18 | Gap between 14 and 11 |
| 19 | Interlocking connection |
| 20 | Direction of movement |

The invention claimed is:

1. A pole basket for a ski pole, cross-country pole, trekking pole, Nordic walking pole or hiking pole, in which the pole basket has a flat surface area, wherein at least some sections of a basket region can be folded towards a pole tip and conversely in an opposite direction up to an upper stop where the basket region forms a flat or only minimally curved plane, and in that the pole basket is folded by means of a force acting on a top of the basket region, and in that when the force is removed, the pole basket returns to an open position independently wherein the basket region features exactly two basket wings that can be folded in the direction of the pole tip and which are arranged to be foldable around a joint hinge, two parallel hinges or hinges arranged at a sharp angle towards the pole tip; and wherein the basket region has a mounting plate that can be rigidly connected to a pole shaft, the basket wings being joined to a bottom of the mounting plate, which at least partially covers the basket wings on the top in a hinge area with a cover section, wherein the cover section also functions as the upper stop for the open position at the same time.

2. The pole basket according to claim 1, wherein the two basket wings are attached to the bottom of the mounting plate facing the pole tip, the basket wings being attached to the bottom by a hinge.

3. The pole basket according to claim 2, wherein the basket wings are attached with a film hinge that consists of a fully elastic synthetic material and/or synthetic ribbon material and/or fiber-reinforced synthetic material.

4. The pole basket according to claim 2, wherein there is at least one rib located on an upper face of the mounting plate facing away from the pole tip and extending upwards.

5. The pole basket according to claim 2, wherein the basket wings are attached with a film hinge that consists of a fully elastic synthetic material and/or synthetic ribbon material and/or fiber-reinforced synthetic material, resulting in two hinges for two basket wings connected through a synthetic layer attached on its underside and extending across both hinge sections.

6. The pole basket according to claim 2, wherein there is at least one rib located on an upper face of the mounting plate facing away from the pole tip and extending upwards, which extends across at least half of a length of the mounting plate, or across at least two thirds of the length of the mounting plate.

7. The pole basket according to claim 1, wherein the mounting plate has an elongated shape and essentially extends across an entire diameter of the pole basket, where a long axis of the mounting plate extends along a direction of movement.

8. The pole basket according to claim 1, wherein the basket region has an asymmetrical design with respect to a pole axis, with an attachment of the pole shaft facing forward in a direction of movement.

9. The pole basket according to claim 1, wherein the basket region is shaped with a slightly concave curvature.

10. The pole basket according to claim 1, wherein the basket wings are essentially parallel to each other when folded and positioned to lie against a section of the pole tip.

11. The pole basket according to claim 1, wherein it is joined to a mounting area for the pole shaft as well as an extension of the tip, and/or constructed in one piece with these elements.

12. The pole basket according to claim 1, wherein the basket wings have recesses.

13. The pole basket according to claim 1, wherein the hinge area is at least partially covered and protected against material entering it by a cover that extends from the mounting plate or the cover section towards a corresponding basket wing.

14. The pole basket according to claim 1, wherein an elastic element is made available to provide the force for an independent return of the pole basket to said open position.

15. The pole basket according to claim 14, wherein the elastic element is a plate spring or a material section which is functional as a plate spring.

16. Ski pole, cross-country pole, trekking pole, Nordic walking pole or hiking pole, or a ski pole intended for the touring sector, with a pole basket according to claim 1.

17. The pole basket according to claim 1, wherein the mounting plate completely covers the basket wings on the top in the hinge area with said cover section.

18. The pole basket according to claim 1, wherein the two basket wings are attached by a film hinge to the bottom of the mounting plate facing the pole tip.

19. The pole basket according to claim 2, wherein the mounting plate has an elongated shape and essentially extends across an entire diameter of the pole basket, where a long axis of the mounting plate extends along a direction of movement, and where the mounting plate in an area of one of its edges is attached and/or adapted to a pole shaft or to a mounting area intended for attachment to the pole shaft.

20. The pole basket according to claim 1, wherein the basket region is shaped with a slightly concave curvature, where an axis of the concave curvature is parallel to a longitudinal axis of a mounting plate, which the foldable elements of the basket region are joined to.

21. The pole basket according to claim 1, wherein it is joined to a mounting area for the pole shaft as well as an extension of the tip, and/or constructed in one piece with these elements, where the pole shaft is attachable in a blind hole recess in the top of the mounting area.

22. A pole basket for a ski pole, cross-country pole, trekking pole, Nordic walking pole or hiking pole, in which the pole basket has a flat surface area, wherein at least some sections of a basket region can be folded towards a pole tip and conversely in an opposite direction up to an upper stop where the basket region forms a flat or only minimally curved plane, and in that the pole basket is folded by means of a force acting on a top of the basket region, and in that when the force is removed, the pole basket returns to an open position independently, wherein a hinge area is at least partially covered and protected against material entering it by a cover that extends from a mounting plate or a cover section of said pole basket towards a corresponding basket wing, a silicon foil or a form element with an elastic pleat and/or an elastic pleat that is at least partially folded in a compressed state, or an accordion shaped elastic pleat, where the cover is elastically adaptable, in that the cover collects energy when the pole basket is folded into its folded state, which will then be released again after the force acting on the upper face of the basket region is discontinued so that the pole basket returns independently into its open state.

* * * * *